US010871282B2

(12) United States Patent
Cheng et al.

(10) Patent No.: US 10,871,282 B2
(45) Date of Patent: Dec. 22, 2020

(54) ILLUMINATOR DEVICE

(71) Applicant: OPPLE LIGHTING CO., LTD., Shanghai (CN)

(72) Inventors: Zhengguang Cheng, Shanghai (CN); Liuhua Xiao, Shanghai (CN); Kun Bai, Shanghai (CN); Hongbo Wang, Shanghai (CN)

(73) Assignee: Oppie Lighting Co., Ltd., Shanghai (CN)

( * ) Notice: Subject to any disclaimer, the term of this patent is extended or adjusted under 35 U.S.C. 154(b) by 160 days.

(21) Appl. No.: 16/222,556

(22) Filed: Dec. 17, 2018

(65) Prior Publication Data

US 2019/0120474 A1 Apr. 25, 2019

Related U.S. Application Data

(63) Continuation of application No. PCT/CN2017/083628, filed on May 9, 2017.

(30) Foreign Application Priority Data

Jun. 23, 2016 (CN) ..... 2016 1 0463893
Jun. 23, 2016 (CN) ..... 2016 2 0630935

(51) Int. Cl.
*F21V 29/503* (2015.01)
*F21K 9/237* (2016.01)
(Continued)

(52) U.S. Cl.
CPC ..... *F21V 29/503* (2015.01); *F21K 9/232* (2016.08); *F21K 9/237* (2016.08); *F21K 9/238* (2016.08);
(Continued)

(58) Field of Classification Search
CPC ..... F21V 29/503; F21V 29/83; F21V 29/773; F21V 23/006; F21K 9/237; F21K 9/232;
(Continued)

(56) References Cited

U.S. PATENT DOCUMENTS 10,030,819 B2 * 7/2018 Athalye ..... F21V 29/77
2005/0174780 A1 * 8/2005 Park ..... F21V 29/506 362/294
(Continued)

FOREIGN PATENT DOCUMENTS

CN 201259106 Y 6/2009
CN 103453335 12/2013
(Continued)

OTHER PUBLICATIONS

International Search Report (including English translation) and Written Opinion issued in PCT/CN2017/083628, dated Aug. 8, 2017, 13 pages.

*Primary Examiner* — Erin Kryukova
(74) *Attorney, Agent, or Firm* — Arch & Lake LLP

(57) ABSTRACT

The present disclosure discloses an illuminator device including a housing, a heat dissipation member at an end of the housing, a light source module configured to include an end in thermal contact with the heat dissipation member, an optical member at another end of the light source module, and a driving power supply module; the light source module and the housing are respectively provided at two ends of the heat dissipation member; by the additional heat dissipation member in the illuminator device and a plurality of channels communicating inside with outside of the illuminator device and penetrating through the housing and the heat dissipation member, the heat emitted by the light source module in the illuminator device can be effectively and rapidly dissipated through the channels.

17 Claims, 8 Drawing Sheets

(51) Int. Cl.

| | |
|---|---|
| ***F21K 9/232*** | (2016.01) |
| ***F21V 29/83*** | (2015.01) |
| ***F21K 9/238*** | (2016.01) |
| ***F21V 23/00*** | (2015.01) |
| ***F21V 29/77*** | (2015.01) |
| ***F21Y 115/10*** | (2016.01) |
| ***F21Y 105/18*** | (2016.01) |
| ***F21Y 103/33*** | (2016.01) |

(52) U.S. Cl.
CPC ..... *F21V 23/006* (2013.01); *F21V 29/773* (2015.01); *F21V 29/83* (2015.01); *F21Y 2103/33* (2016.08); *F21Y 2105/18* (2016.08); *F21Y 2115/10* (2016.08)

(58) Field of Classification Search
CPC .. F21K 9/238; F21Y 2103/33; F21Y 2115/10; F21Y 2105/18
See application file for complete search history.

(56) References Cited

U.S. PATENT DOCUMENTS

2008/0158887 A1* 7/2008 Zhu ..... F21V 29/745 362/294
2009/0046473 A1* 2/2009 Tsai ..... F21V 29/773 362/373
2009/0141500 A1* 6/2009 Peng ..... F21K 9/233 362/294
2009/0296402 A1* 12/2009 Chang ..... F21K 9/238 362/294
2010/0232168 A1* 9/2010 Horng ..... F21V 29/677 362/373
2010/0277067 A1* 11/2010 Maxik ..... F21V 3/00 315/32
2011/0204790 A1* 8/2011 Arik ..... F21K 9/238 315/113
2012/0161602 A1* 6/2012 Yu ..... F21V 29/83 313/46
2012/0194055 A1* 8/2012 Wu ..... F21V 29/773 313/46
2012/0248961 A1* 10/2012 Lai ..... F21K 9/238 313/46
2013/0128589 A1* 5/2013 Kim ..... F21V 29/67 362/294
2013/0163240 A1 6/2013 Chen
2013/0223061 A1* 8/2013 Hwu ..... F21V 29/74 362/235
2013/0257278 A1* 10/2013 DeVore ..... F21V 23/06 315/113
2014/0063809 A1* 3/2014 Huang ..... F21V 29/773 362/294
2015/0211723 A1* 7/2015 Athalye ..... F21V 29/77 362/294

FOREIGN PATENT DOCUMENTS

| | | | | |
|---|---|---|---|---|
| CN | 204437777 U | 7/2015 | | |
| CN | 204629144 U | 9/2015 | | |
| CN | 106051646 | 10/2016 | | |
| CN | 205806983 U | 12/2016 | | |
| JP | 5600936 B | 7/2011 | | |
| WO | WO-2012129893 A1 * | 10/2012 | ..... | F21V 29/773 |

* cited by examiner

ILLUMINATOR DEVICE

CROSS-REFERENCE TO RELATED APPLICATIONS

This application is based upon and claims the priority of PCT patent application No. PCT/CN2017/083628 filed on May 9, 2017 which claims the priority of Chinese Patent Application No. 201610463893.2 filed on Jun. 23, 2016 and Chinese Patent Application No. 201620630935.2 filed on Jun. 23, 2016, the entire content of all of which is hereby incorporated by reference herein for all purposes.

TECHNICAL FIELD

The present disclosure belongs to the field of semiconductor illumination technology, and in particular relates to an illuminator device.

BACKGROUND

After a lamp, especially a high-power lamp, is illuminated and is used for a period of time, the temperature of the entire lamp can be high, and the service life of the lamp can be greatly shortened if the lamp cannot effectively dissipate heat. Therefore, the high-power lamp is generally provided with a heat dissipation structure between a lamp housing and an encloser.

SUMMARY

The present disclosure provides an illuminator device and a method of manufacturing an illuminator device.

According to a first aspect, the present disclosure provides an illuminator device. The device may include: a housing, a heat dissipation member provided at an end of the housing, a light source module configured to include an end in thermal contact with the heat dissipation member, an optical member provided at an other end of the light source module, and a driving power supply module electrically connected with the light source module, where the light source module and the housing are respectively provided at two ends of the heat dissipation member, a plurality of channels communicating inside of the illuminator device with outside of the illuminator device are provided in the illuminator device, and the plurality of channels penetrate through the housing and the heat dissipation member.

According to a second aspect, the present disclosure provides a method of manufacturing an illuminator device. The method may include: providing a housing and a heat dissipation member provided at an end of the housing, providing a light source module configured to include an end in thermal contact with the heat dissipation member, providing an optical member provided at an other end of the light source module, and providing a driving power supply module electrically connected with the light source module, and where the light source module and the housing may be respectively provided at two ends of the heat dissipation member, a plurality of channels communicating inside of the illuminator device with outside of the illuminator device are provided in the illuminator device, and the plurality of channels penetrate through the housing and the heat dissipation member.

It is to be understood that both the foregoing general description and the following detailed description are exemplary and explanatory only and are not restrictive of the present disclosure.

BRIEF DESCRIPTION OF THE DRAWINGS

The accompanying drawings illustrated here are only provided for further understanding of the present disclosure and constitute one part of the present disclosure. The examples of the present disclosure and the description thereof are used for explaining the present disclosure and do not constitute an improper limitation of the present disclosure. In the accompanying drawings.

DETAILED DESCRIPTION

In order to make objects, technical details and advantages of the examples of the disclosure apparent, the technical solutions of the examples will be described in a clearly and fully understandable way in connection with the examples of the disclosure and related drawings. Apparently, the described examples are just a part but not all of the examples of the disclosure. Based on the described examples herein, those skilled in the art can obtain other example(s), without any inventive work, which should be within the scope of the disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Some heat dissipation structures may be made of aluminum alloy and provided with a plurality of fins which are closely arranged, so the structure is complex. Thus, the entire lamp has large weight, which exceeds the weight that a lamp holder (e.g., the standard lamp holder E27 or E40) of the lamp can bear. Therefore, the illuminator device also needs to be additionally equipped with a safety chain. The safety chain is connected between a mounting bracket and a light source, thus not only increasing the cost of the high-power lamp but also being inconvenient to replace the light source.

Figure 1:
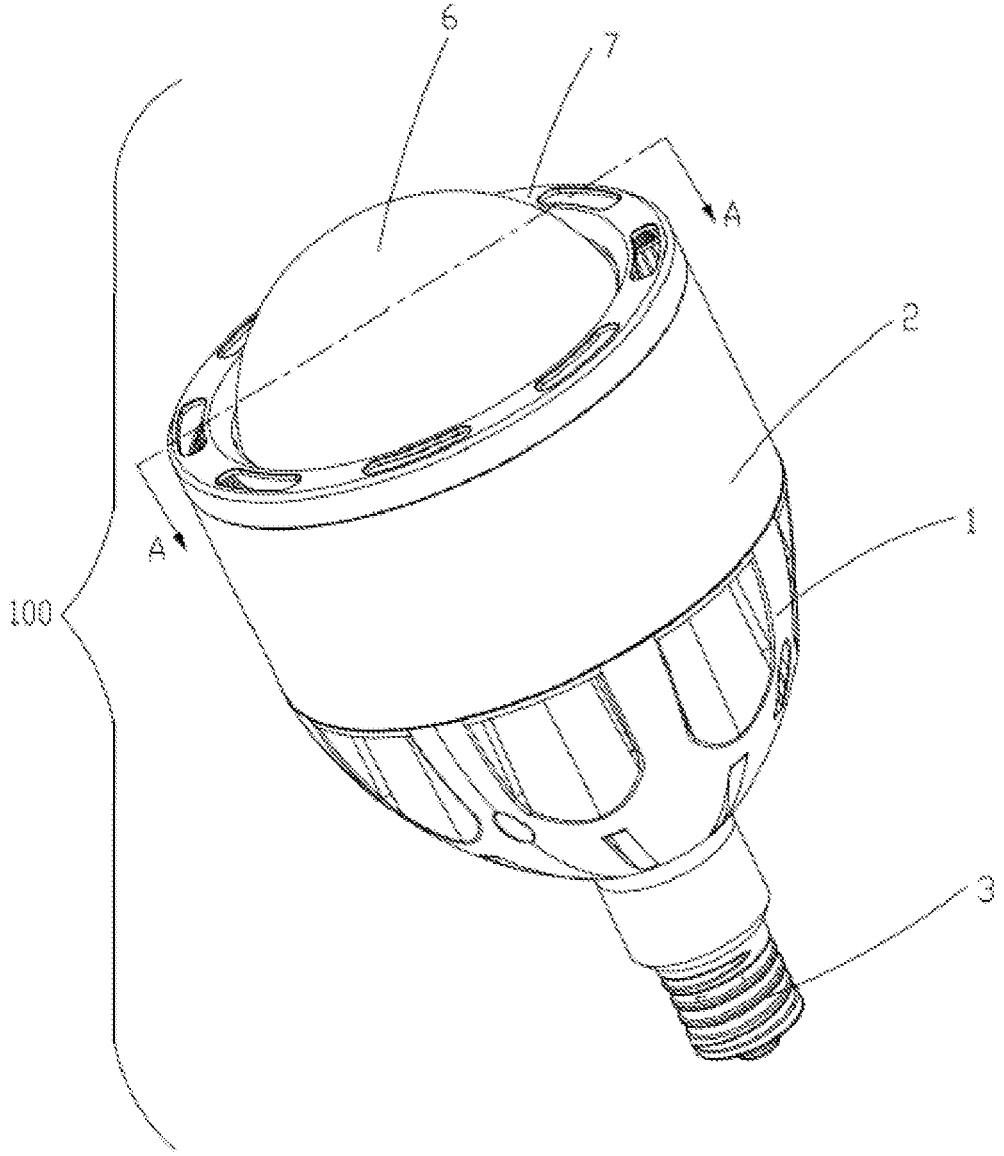
FIG. 1 is a schematic three-dimensional assembly view of an illuminator device provided by an example of the present disclosure.
Figure 2:
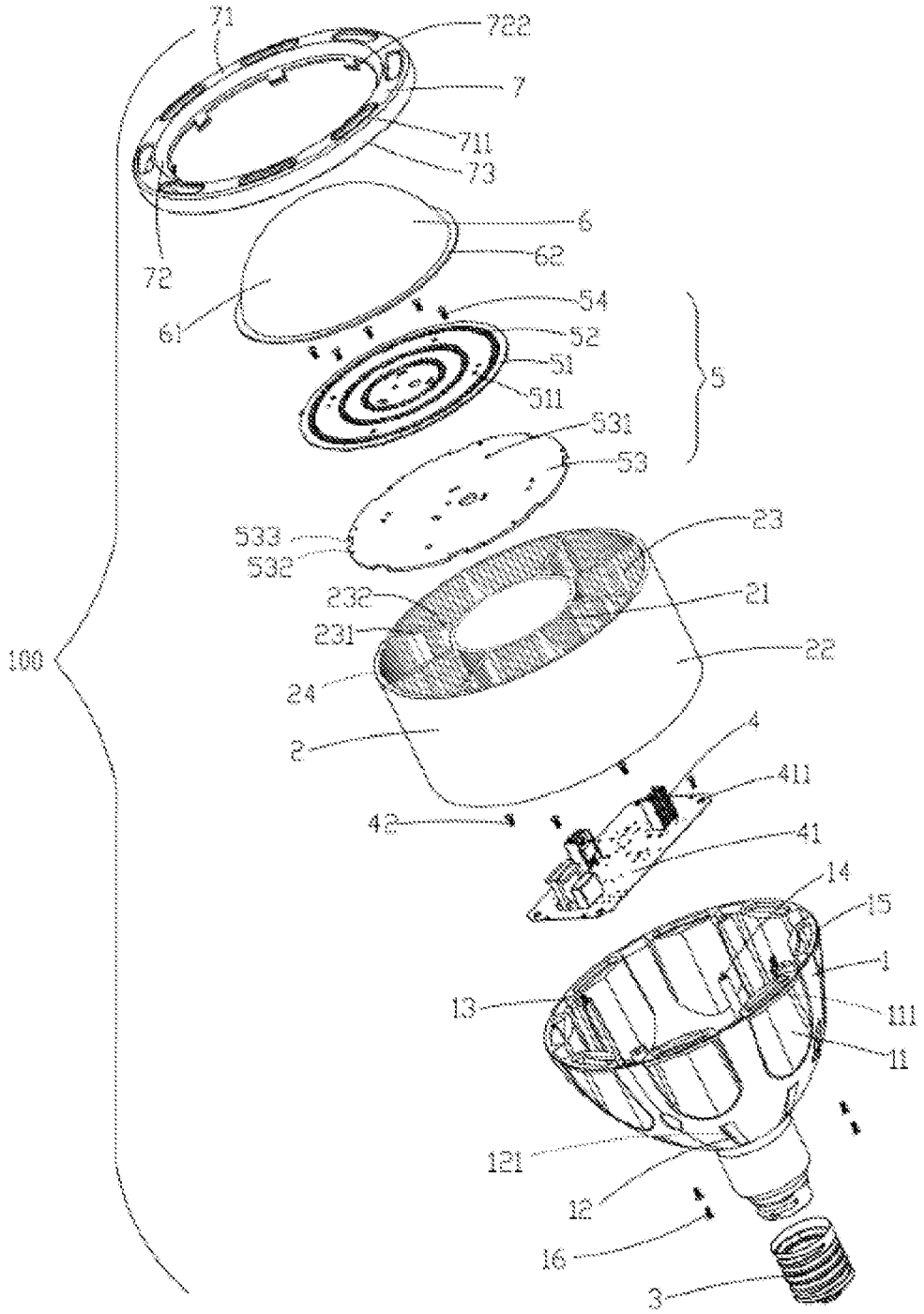
FIG. 2 is a schematic exploded view of FIG. 1.
Figure 3:
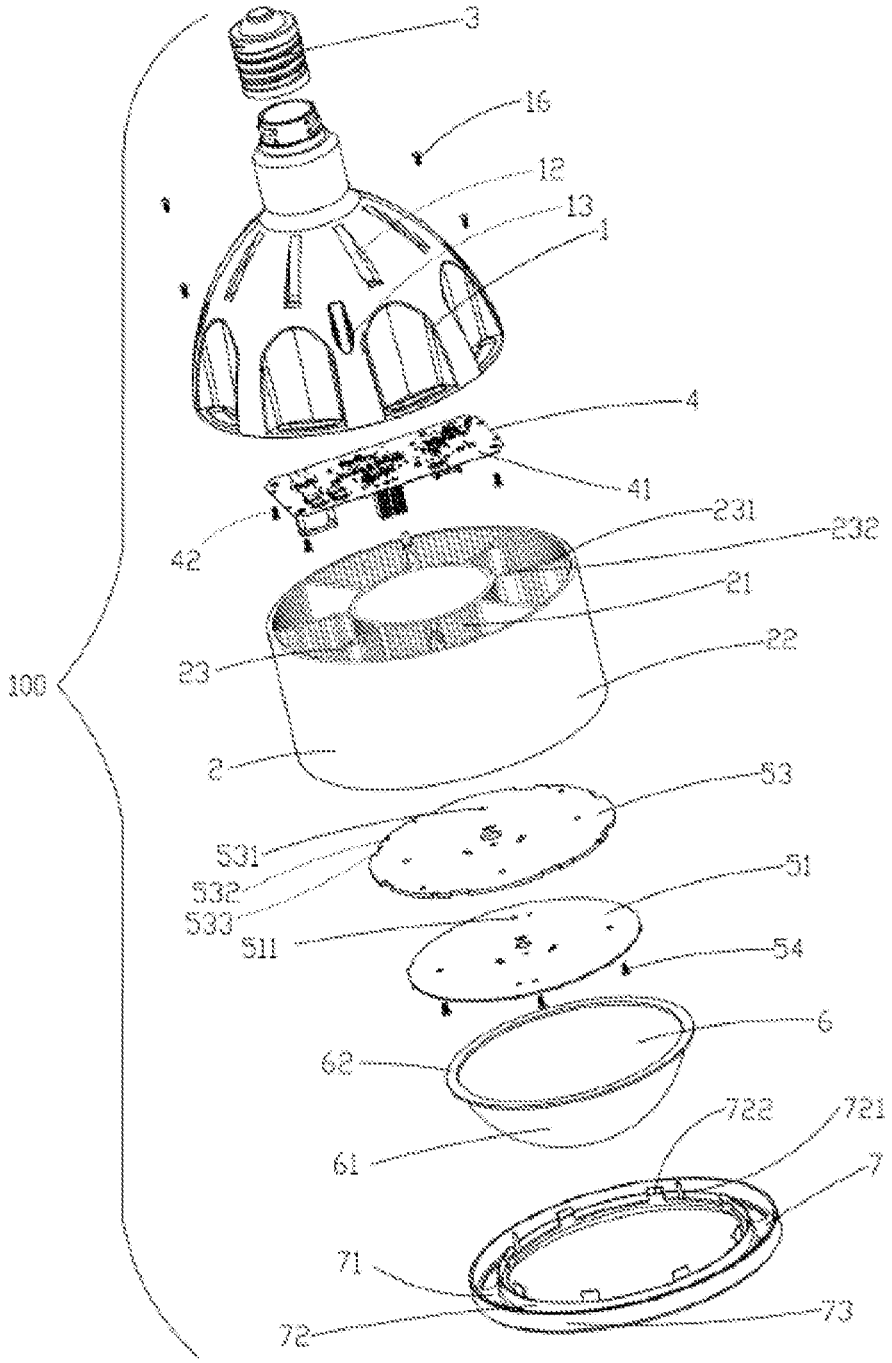
FIG. 3 is a schematic exploded view of FIG. 1 from another viewpoint.

FIG. 1 to FIG. 3 illustrate an illuminator device 100 provided by the example of the present disclosure, which is a high-power light bulb. The illuminator device 100 includes a housing 1, a heat dissipation member 2 provided at an end of the housing 1, a light source module 5 configured to include an end in thermal contact with the heat dissipation member 2, an optical member 6 provided at another end of the light source module 5, an encloser 7 connected with the light source module 5 and configured to position the optical member 6 at the end of the light source module 5, a lamp holder 3 connected to another end of the housing 1, and a driving power supply module 4 accommodated into the housing 1 and electrically connected with the light source module 5. In the illuminator device 100, the light source module 5 and the housing 1 are respectively provided at two ends of the heat dissipation member 2. The heat dissipation member 2 is in thermal contact with the light source module 5, so that the heat emitted by the light source module 5 can be transferred to the heat dissipation member 2 and then be dissipated to the outside of the illuminator device 100 through the heat dissipation member 2. The heat transfer medium may be air or other heat-conducting materials.

Figure 8:
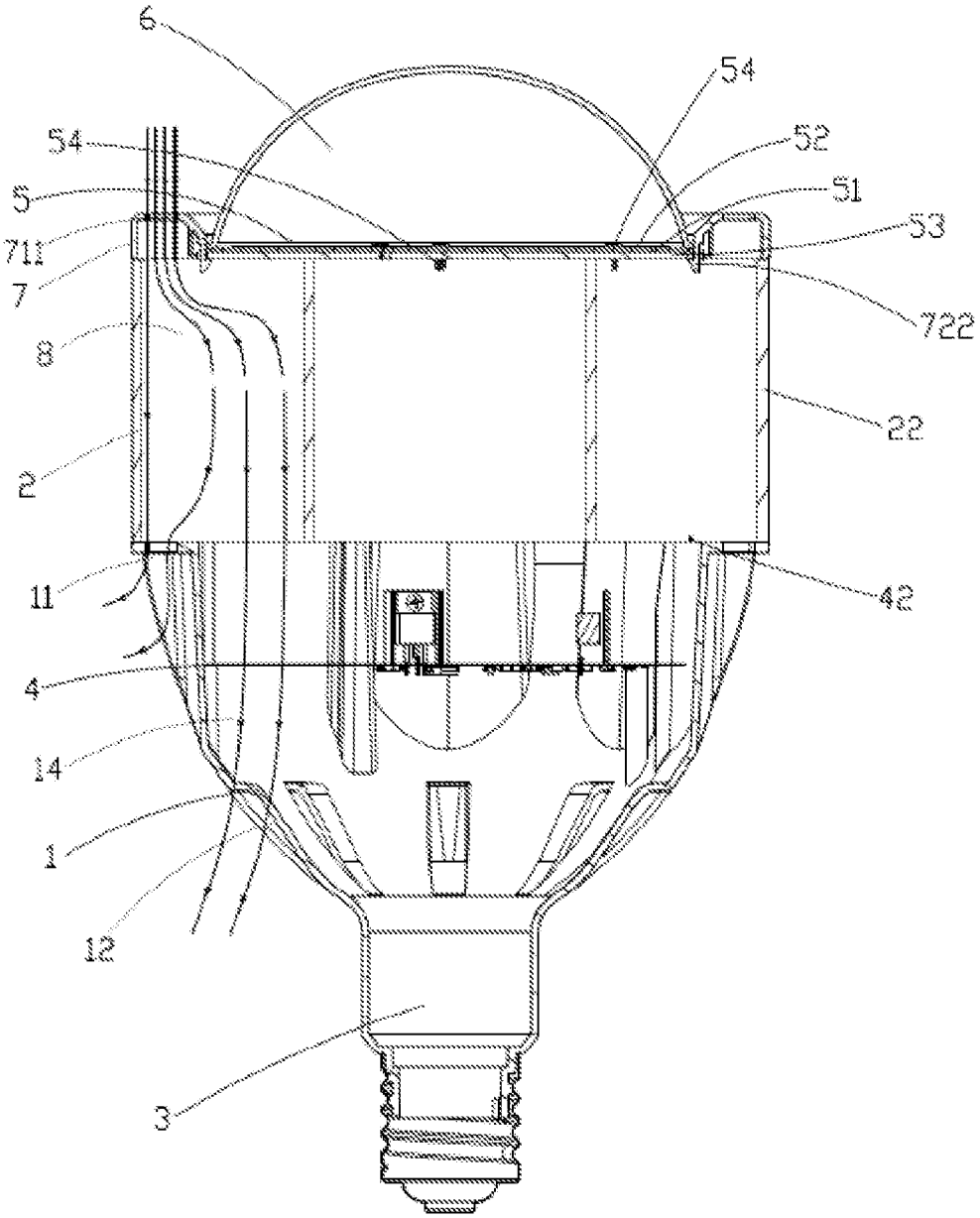
FIG. 8 is a schematic sectional view along the A-A line in FIG. 1.

As shown in FIG. 8, a plurality of channels 8 communicating the inside of the illuminator device 100 with the outside of the illuminator device 100 are provided in the illuminator device 100. In the illuminator device 100, each channel 8 penetrates through the housing 1, the heat dissipation member 2 and the encloser 7. The channels 8 can realize the convection between the air outside the illuminator device 100 and the air inside the illuminator device 100. The illuminator device 100 may be a high-power LED lamp for indoor lighting, which may be mounted on a mounting base such as a ceiling. The lamp holder 3 is electrically connected with the internal driving power supply module so as to electrically connect the illuminator device 100 to the commercial power.

Detailed description will be given below to the components and the connecting relationships between the components in the illuminator device 100, provided by the example of the present disclosure.

Figure 4:
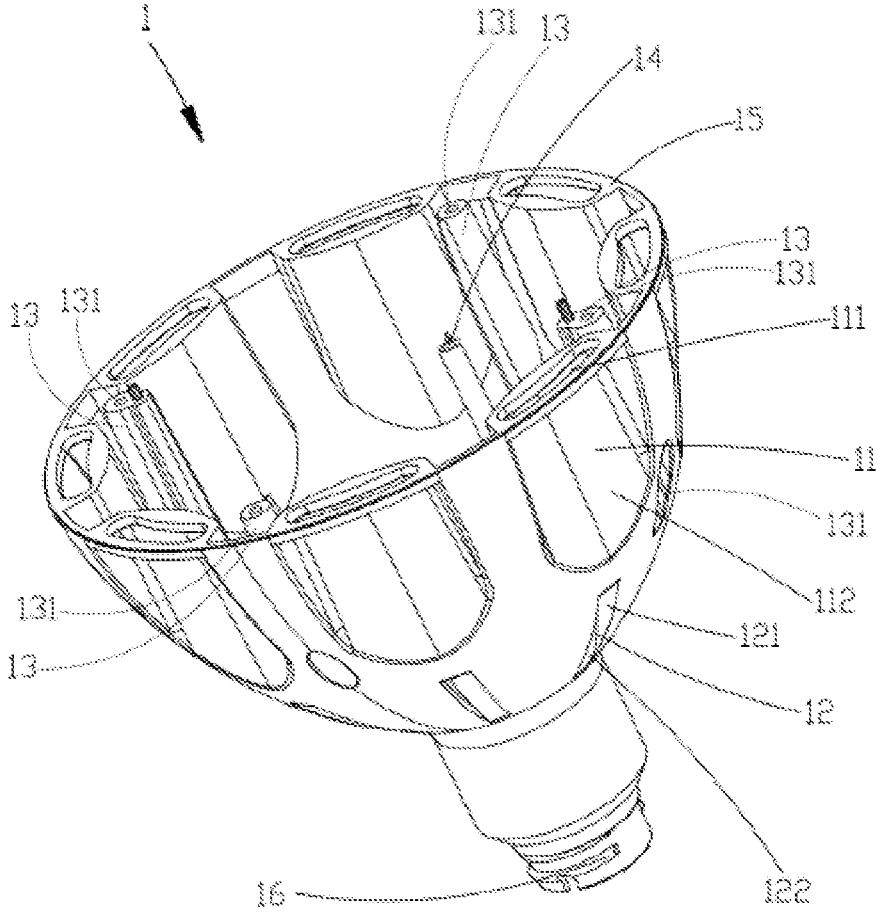
FIG. 4 is a schematic view of a housing in the illuminator device provided by the example of the present disclosure.
Figure 5:
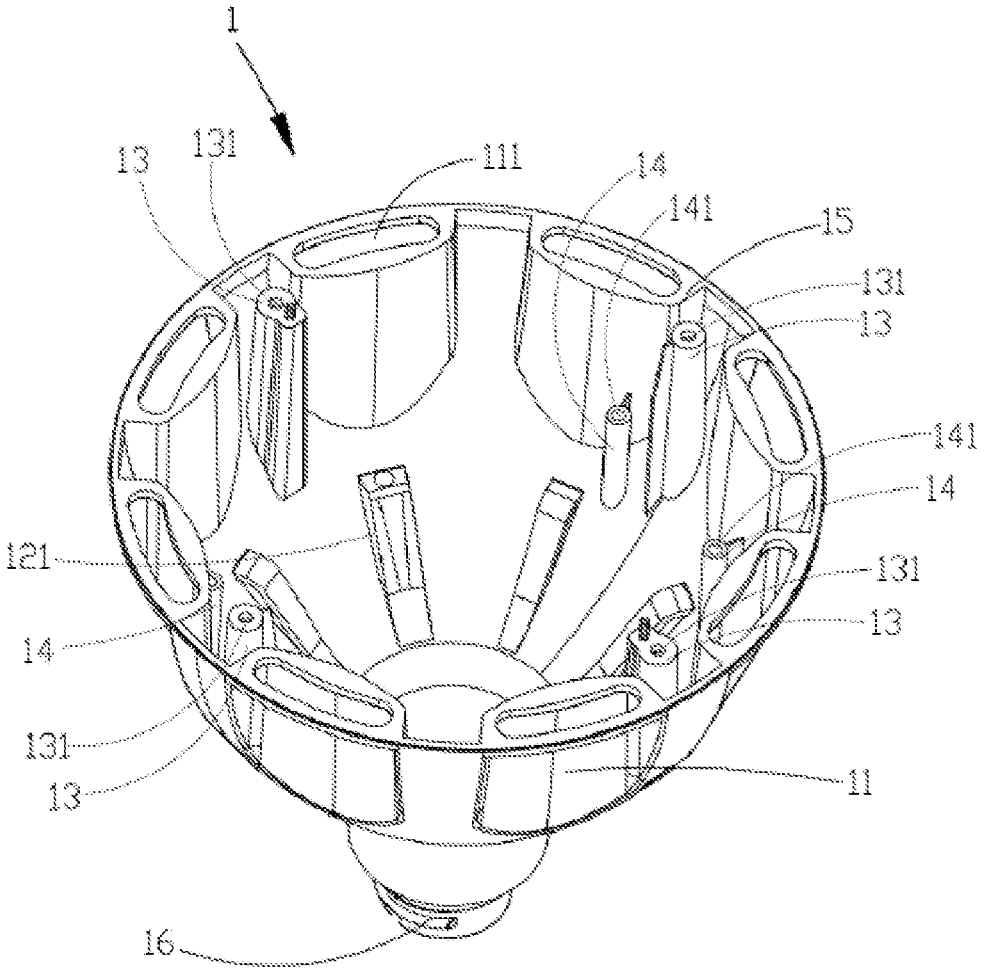
FIG. 5 is a schematic view of the housing in FIG. 4 from another viewpoint.

As shown in FIG. 2, FIG. 4 and FIG. 5, the housing 1 is in the shape of a cap and is formed in a one-piece form by an insulating material. The housing 1 is provided with a plurality of first through grooves 11 and a plurality of second through grooves 12. The housing 1 is provided therein with a plurality of first positioning columns 13 connected with the heat dissipation member 2 and a plurality of second positioning columns 14 for supporting the light source module 5. A horizontal end face is provided at an end of the housing 1 and bonded to an end of the heat dissipation member 2. The horizontal end face of the housing 1 may be defined to be a first end face 15 of the housing 1. Another end of the housing 1 is connected with the lamp holder 3; an outer surface of another end of the housing 1 is provided with screw threads; and the lamp holder 3 may be in threaded connection with the another end of the housing 1.

Specifically, the first through grooves 11 extend to an outer surface of a side wall of the housing 1 from the first end face 15 of the housing 1. The first through groove 11 is communicated with at least one channel 8 and includes a first port 111 and a first groove 112 which are communicated with each other. The first port 111 is provided at the first end face 15. The first groove 112 is formed by denting the outer surface of the side wall. By adoption of the first through grooves 11, the inner space of the housing 1 may be communicated with the outside of the illuminator device 100.

Specifically, the second through grooves 12 penetrate through an inner surface and the outer surface of the side wall of the housing 1. The second through groove 12 is communicated with at least one channel 8. The second through groove 12 includes two second ports 121 and one second groove 122, in which the second ports 121 penetrate through the inner surface and the outer surface of the side wall of the housing 1; the second groove 122 is formed by denting the outer surface of the side wall; and the two second ports 121 are respectively formed on two sides of the second groove 122. The second through grooves 12 further enhance the communication between the inner space of the housing 1 and the outer space of the illuminator device 100. Other examples may also adopt the form of only arranging the first through grooves or the second through grooves.

Figure 6:
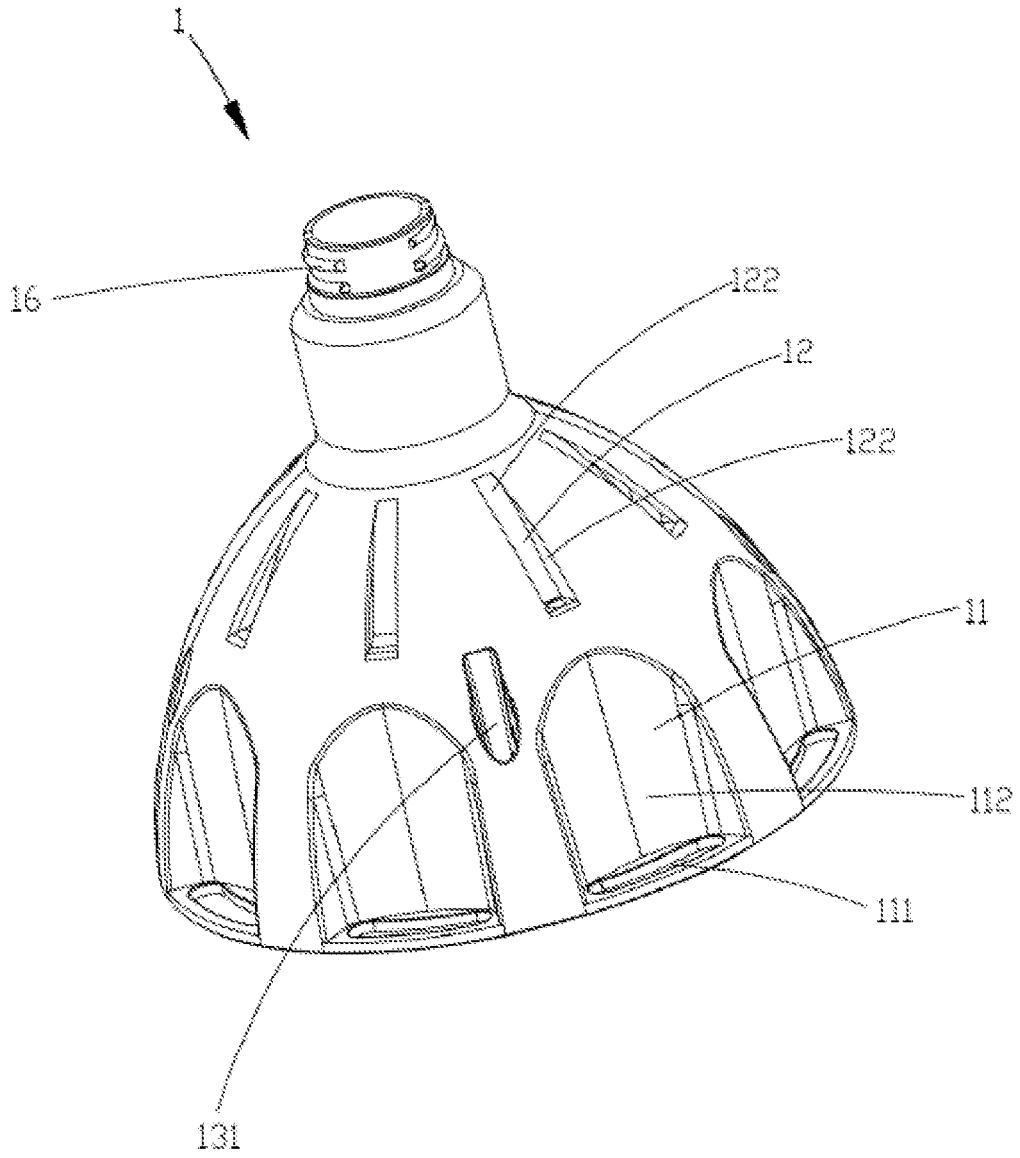
FIG. 6 is a schematic view of the housing in FIG. 4 from still another viewpoint.

As shown in FIG. 4, a plurality of first positioning columns 13 are formed inside the housing 1; a top surface of the first positioning column 13 is flush with the first end face 15; and a first positioning hole 131 which extends from the top surface of the first positioning column 13 to the outer surface of the housing 1 is formed in the first positioning column 13. With reference to FIG. 5 and FIG. 8, a plurality of second positioning columns 14 are provided inside the housing 1; a top surface of the second positioning column 14 is lower than the first end face 15; and the top surfaces of the plurality of second positioning columns 14 form a receiving surface for placing the driving power supply module 4 together. Second positioning holes 141 are formed in the second positioning columns 14 respectively. FIG. 6 is a schematic view of the housing in FIG. 4 from another viewpoint.

Figure 7:
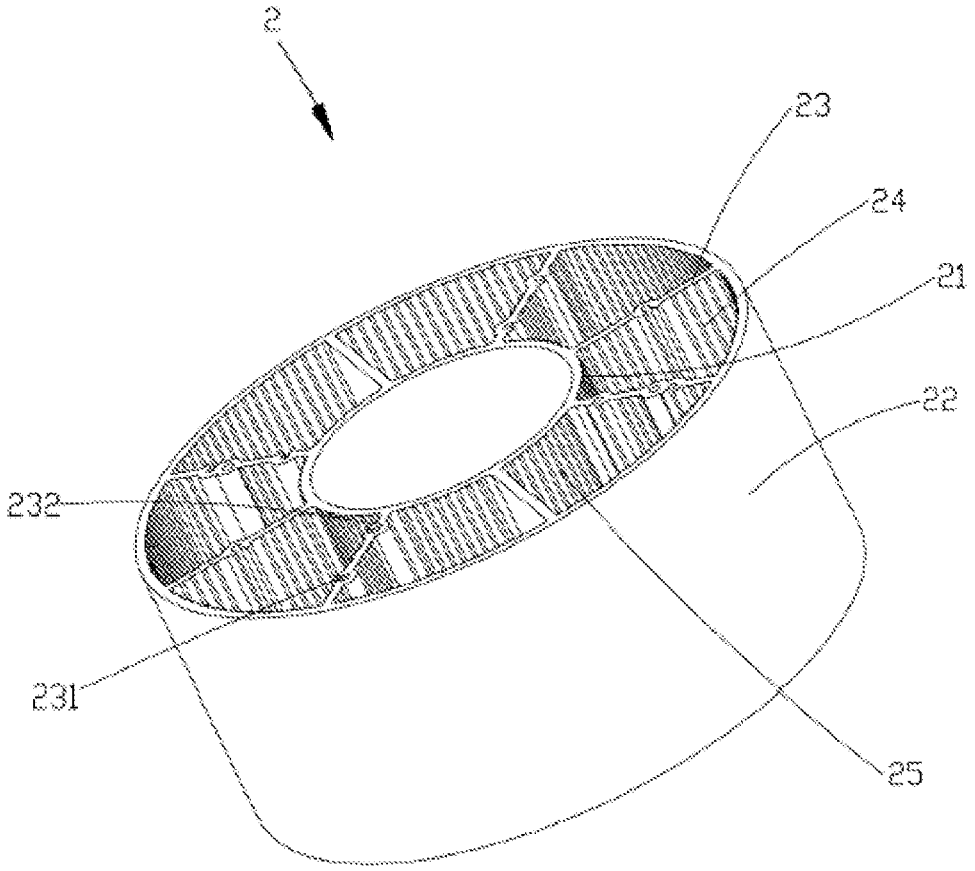
FIG. 7 is a schematic view of a heat dissipation member in the illuminator device provided by the example of the present disclosure.

As shown in FIG. 3 and FIG. 7, the heat dissipation member 2 is toroidal columnar and made of a metallic material with good thermal conductivity such as aluminum, and the outside diameter of the heat dissipation member 2 is flush with the outside diameter of the housing 1. The heat dissipation member 2 includes a first end (not signed) and a second end (not signed) arranged in an upper-lower direction, the first end of the heat dissipation member 2 is fixedly connected with the light source module 5, and the second end of the heat dissipation member 2 is fixedly connected with the hosing 1. The heat dissipation member 2 includes a round inner ring 21, a round outer ring 22, and a plurality of connecting parts 23 extending along a radial direction and connecting the inner ring 21 and the outer ring 22. Specifically, the inner ring 21 and the outer ring 22 are concentrically arranged, and the plurality of connecting parts 23 extend along a vertical direction and uniformly distributed between the inner ring 21 and the outer ring 22. The shape of the connecting part 23 is not limited to be a linear plate, or may also be curved, etc. By adoption of the above design, a plurality of pipes 24 extending longitudinally are formed in the heat dissipation member 2. The pipes 24 are formed due to enclosure of the inner ring 21, the outer ring 22 and the connecting parts 23. Moreover, the connecting parts 23 are provided with a plurality of vertical third positioning holes 231 and vertical fourth positioning holes 232, in which the third positioning holes 231 correspond to the first positioning holes 131.

As shown in FIG. 2, FIG. 3, FIG. 4 and FIG. 7, the illuminator device 100 further includes a plurality of first screws 16. The first screws 16 penetrate through the first positioning holes 131 of the first positioning columns 13 and are accommodated into the third positioning holes 231 to realize the fixed connection between the housing 1 and the heat dissipation member 2. The wall surfaces of the plurality of pipes 24 of the heat dissipation member 2 are provided with a plurality of vertical protruding strips 25. The protruding strips 25 are configured to increase the internal surface area of the heat dissipation member 2 and enhance the heat dissipation effect. Other examples may also adopt other connecting means such as bonding connection, fastener connection or welding connection.

The heat dissipation member 2 is preferably made of aluminum profile. The heat dissipation member with required length is cut from an aluminum profile matrix with corresponding diameter according to different lamp powers, luminous fluxes and photoelectric parameters. The powers may range from tens of watts to hundreds of watts, and the luminous fluxes may range from hundreds of lumens to tens of thousands of lumens. The traditional high-power light sources such as high-power fluorescent lamps and high-power metal halide lamps can be well replaced. Meanwhile, one set of aluminum profile mold can obtain a plurality of illuminator devices provided by the example of the disclosure with different powers, so the production cost can be greatly reduced.

As shown in FIG. 2 and FIG. 3, the light source module 5 includes a second substrate 51, a light source 52 provided on a side of the second substrate 51, and a heat homogenization plate 53 provided on another side of the second substrate 51. The heat homogenization plate 53 is in thermal contact with the heat dissipation member 2, and emergent light from the light source 52 is emitted at least after light homogenization or light distribution by the optical member 6. In the example of the present disclosure, the light source adopts a light-emitting diode (LED) light source and is annularly arranged, the light source may be provided to be an annular LED light source, or the light source may be provided to include a plurality of concentric annular LED light sources. In other examples, the light source may adopt TL light sources or other light sources.

The second substrate 51 may be a printed circuit board, and the second substrate 51 is provided with a plurality of fifth positioning holes 511. The heat homogenization plate 53 is a vacuum cavity having a fine structure at an inner wall, is made of metal with good thermal conductivity such as copper, and is configured to enhance heat dissipation. A surface of the heat homogenization plate 53 is provided with a plurality of sixth positioning holes 531, and the circumference of the heat homogenization plate 53 is further provided with a plurality of seventh positioning holes 532 and a plurality of clamping grooves 533. The illuminator device 100 further includes a plurality of second screws 54. The second screws 54 penetrate through the fifth positioning holes 511 and the sixth positioning holes 531 and are accommodated into the fourth positioning holes 232 to realize the fixed connection between the light source module 5 and the heat dissipation member 2. Moreover, the light source module 5 is bonded to the first end (not signed) of the heat dissipation member 2. In other examples, other connecting means such as bonding connection, fastener connection or welding connection may also be adopted.

As shown in FIG. 2 and FIG. 8, the driving power supply module 4 includes a plurality of elements, including but not limited to an LED driving controller chip, a rectifying chip, a resistor, a capacitor, a fuse wire and a coil, which are all mounted on the first substrate 41 of the driving power supply module 4; through holes 411 corresponding to four second positioning columns 14 are formed at the first substrate 41; and the first substrate 41 is provided on a receiving surface in the housing 1, formed by the four second positioning columns 14. The illuminator device 100 further includes four third screws 42. The third screws 42 penetrate through the through holes 411 and are accommodated into the second positioning columns 14 to fix the first substrate 41 in the housing 1. In other examples, the driving power supply module 4 and the light source module 5 may also be provided in a one-piece form; and the driving power supply module 4 and the light source module 5 may be provided on the same surface or different surfaces of the substrate.

As shown in FIG. 2 and FIG. 3, in the example of the present disclosure, the optical member 6 adopts a bubble cap, is formed in a one-piece form by an insulating material such as plastic, and is semispherical. The optical member 6 includes a light-transmissive part 61 taken as a central part and protruded out of an upper surface of the encloser 7, and a horizontal edge part 62 extending to the outside from a side of the light-transmissive part 61. In the example of the present disclosure, the second substrate 51 of the light source module 5 abuts against the heat dissipation member 2 through the edge part 62; and a plurality of notches (not shown in the figures) are formed at the edge part 62 of the light-transmissive part 61. In other examples, a TIR lens, a COB lens, a bulb-cap type light homogenizing shade, or a combination of a lens and a bulb cap may also be taken as the optical member; and as for the annular light source, the optical member may also be correspondingly set to be annular.

As shown in FIG. 2, FIG. 3, FIG. 4 and FIG. 8, the encloser 7 is in the shape of a circular ring and is arranged around the edge part 62 of the optical member 6. The encloser 7 includes a horizontal part 71 and a first vertical part 72 and a second vertical part 73 which are provided on two sides of the horizontal part 71 respectively. The outside diameter of the encloser 7 is flush with the outside diameter of the heat dissipation member 2. A plurality of positioning columns 721 and elastic clamping arms 722 are provided at the first vertical part 72. The positioning columns 721 may cooperate with the seventh positioning holes 532 at the heat homogenization plate 53. The elastic clamping arms 722 penetrate through the plurality of notches (not shown in the figure) of the edge part 62 and the clamping grooves 533 formed at the edge of the heat homogenization plate 53, and are clamped into the edge of the heat homogenization plate 53. Thus, the combination of the encloser 7 and the heat homogenization plate 53 is realized, so the fixed connection between the encloser 7 and the light source module 5 can be realized. A plurality of first openings 711 are formed at the horizontal part 71. The first openings 711 are aligned with the first through grooves 11 in an upper-lower direction. The pipes 24 are respectively communicated with the first through grooves 11 and the first openings 711. The first openings 711, the pipes 24 and the first through holes 11 form the channels 8. The airflow from the outside of the illuminator device 100 enters the first openings 711, penetrates through the channels 8 and then the pipes 24 of the heat dissipation member 2, and is discharged from the first ports 112 and the second ports 122 of the housing 1, so as to form internal and external convection and achieve effective heat dissipation. In other examples, the encloser may be removed; the structure of the optical member is adjusted and designed to be flush with the outside diameter of the heat dissipation member 2 and be fixedly connected with the heat dissipation member 2; and the optical member is provided with a structure taken as one part of the channel for heat dissipation.

In summary, the illuminator device 100 provided by the examples of the present disclosure is provided with a plurality of channels communicating the inside of the illuminator device 100 with the outside of the illuminator device 100; and the channels may be utilized to realize the convection between the air outside the illuminator device 100 and the air inside the illuminator device 100.

With reference to FIG. 7 and FIG. 8, the flow of the heat dissipation airflow is divided into at least two parts: one path aligned in the upper-lower direction has a rapid first flow rate; and the other path diffused into the large-size pipes 24 has a second flow rate, the second flow rate is lower than the first flow rate, and the path of airflow can fully exchange heat with the inner walls of the pipes 24. Thus, the heat emitted by the light source module 5 in the illuminator device 100 can be effectively and rapidly dissipated through the channels 8. Therefore, the illuminator device 100 has good heat dissipation effect, and then the service life of the light source module 5 in the illuminator device 100 can be prolonged. On the other hand, the heat dissipation member 2 has simple structure and light weight, so the weight of the entire illuminator device 100 is reduced and the light source module 5 may be replaced without the need of the additional installation of a safety chain, so that the illuminator device 100 is easy to assemble and disassemble.

The present disclosure provides an illuminator device with good heat dissipation effect.

The present disclosure provides an illuminator device which includes a housing, a heat dissipation member provided at an end of the housing, a light source module configured to include an end in thermal contact with the heat dissipation member, an optical member provided at an other end of the light source module, and a driving power supply module electrically connected with the light source module, the light source module and the housing are respectively provided at two ends of the heat dissipation member, a plurality of channels communicating inside of the illuminator device with outside of the illuminator device are provided in the illuminator device, and the plurality of channels penetrate through the housing and the heat dissipation member.

Further, the illuminator device further includes an encloser which positions the optical member at the other end of the light source module.

Further, the housing is formed with a plurality of first through grooves; a plurality of pipes are formed in the heat dissipation member; the encloser is provided with a plurality of first openings; the plurality of pipes are respectively communicated with the plurality of first through grooves and the plurality of first openings; and the plurality of first through grooves, the plurality of pipes and the plurality of first openings form the plurality of channels.

Further, each of the first through grooves includes a first port and a first groove which are communicated with each other; the first port is provided at the first end face and communicated with at least one of the plurality of pipes; and the first groove is formed by denting the outer surface of the side wall.

Further, the housing is formed with a plurality of second through grooves; and the plurality of second through grooves penetrate through both an inner surface and the outer surface of the side wall of the housing.

Further, each of the second through grooves includes at least one second port and a second groove which are communicated with each other; the at least one second port penetrates through the inner surface and the outer surface of the side wall of the housing and is communicated with at least one of the plurality of pipes; and the second groove is formed by denting the outer surface of the side wall.

Further, the heat dissipation member is toroidal columnar and includes an inner ring, an outer ring and a plurality of connecting plates connecting the inner ring and the outer ring; and the plurality of pipes are formed by enclosure of the inner ring, the outer ring and the plurality of connecting plates.

Further, the light source module includes a substrate and a light source provided on a side of the substrate; and emergent light from the light source is emitted at least after light homogenization or light distribution by the optical member.

Further, the light source is annularly arranged.

Further, the illuminator device further includes a heat homogenization plate which is provided on another side of the substrate and is in thermal contact with the heat dissipation member.

Further, the light source module and the driving power supply module are separately provided; and the driving power supply module is fixed in the housing.

Further, the light source module and the driving power supply module are provided in a one-piece form.

Further, the optical member includes an edge part and a central part; the encloser is provided around the edge part of the optical member; and the central part of the optical member is protruded out of an upper surface of the encloser.

Further, the encloser is combined with the heat homogenization plate.

Further, the heat dissipation member includes a first end and a second end arranged in an upper-lower direction; and the housing is fixedly connected with the second end of the heat dissipation member and bonded to the second end.

Further, the heat dissipation member includes a first end and a second end arranged in an upper-lower direction; and the light source module is fixedly connected with the first end of the heat dissipation member and bonded to the first end.

Further, the illuminator device further includes a lamp holder which is electrically connected with the driving power supply module and configured to electrically connect the illuminator device to an external power supply.

Compared with other implementations, in the illuminator device provided by the examples of the present disclosure, by utilization of an external heat dissipation member and the arrangement of a plurality of channels communicating the inside of the illuminator device with the outside of the illuminator device, the convection between the air outside the illuminator device and the air inside the illuminator device can be realized by utilization of the channels. Thus, the heat emitted by the light source module in the illuminator device can be effectively and rapidly dissipated through the channels. Therefore, the illuminator device has good heat dissipation effect, and then the service life of the light source module in the illuminator device is prolonged.

The present disclosure provides a method of manufacturing an illuminator device. The method may include: providing a housing and a heat dissipation member provided at an end of the housing, providing a light source module configured to include an end in thermal contact with the heat dissipation member, providing an optical member provided at an other end of the light source module, and providing a driving power supply module electrically connected with the light source module, and where the light source module and the housing are respectively provided at two ends of the heat dissipation member, a plurality of channels communicating inside of the illuminator device with outside of the illuminator device are provided in the illuminator device, and the plurality of channels penetrate through the housing and the heat dissipation member.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The foregoing examples are provided for further detailed description of the objectives, the technical solutions and the advantages of the present disclosure. It should be understood that the foregoing is only the examples of the present disclosure and not intended to limit the present disclosure. Any modification, equivalent replacement, improvement or the like made within the spirit and the principle of the present disclosure shall fall within the scope of protection of the present disclosure.

In addition, it should be also noted that: the language used in the description is mainly selected for the purpose of readability and teaching, and is not selected for the purpose of explaining or limiting the subject of the present disclosure. Therefore, many modifications and variations will be apparent to those skilled in the art without departing from the scope and the spirit of the disclosure. The disclosure of the present disclosure is illustrative and not restrictive as for the scope of the disclosure.

What is claimed is:

1. An illuminator device, comprising:

a housing, a heat dissipation member provided at an end of the housing, a light source module configured to comprise an end in thermal contact with the heat dissipation member, an optical member provided at an other end of the light source module, an encloser which positions the optical member at the other end of the light source module, and a driving power supply module electrically connected with the light source module, wherein the light source module and the housing are respectively provided at two ends of the heat dissipation member, a plurality of channels communicating inside of the illuminator device with outside of the illuminator device are provided in the illuminator device, and the plurality of channels penetrate through the housing and the heat dissipation member, and wherein the housing comprises a plurality of first through grooves; a plurality of pipes are disposed in the heat dissipation member; the encloser is provided with a plurality of first openings; the plurality of pipes are respectively communicated with the plurality of first through grooves and the plurality of first openings; and the plurality of first through grooves, the plurality of pipes and the plurality of first openings form the plurality of channels.

2. The illuminator device according to claim 1, wherein the housing is provided with a first end face in contact with an end of the heat dissipation member; and the plurality of first through grooves extend to an outer surface of a side wall of the housing from the first end face.

3. The illuminator device according to claim 2, wherein each of the first through grooves comprises a first port and a first groove which are communicated with each other; the first port is provided at the first end face and communicated with at least one of the plurality of pipes; and the first groove is formed by denting the outer surface of the side wall.

4. The illuminator device according to claim 3, wherein the housing is further comprises a plurality of second through grooves; and the plurality of second through grooves penetrate through both an inner surface and the outer surface of the side wall of the housing.

5. The illuminator device according to claim 4, wherein each of the second through grooves comprises at least one second port and a second groove which are communicated with each other; the at least one second port penetrates through the inner surface and the outer surface of the side wall of the housing and is communicated with at least one of the plurality of pipes; and the second groove is formed by denting the outer surface of the side wall.

6. The illuminator device according to claim 1, wherein the heat dissipation member is toroidal columnar and comprises an inner ring, an outer ring and a plurality of connecting parts connecting the inner ring and the outer ring; and the plurality of pipes are formed by enclosure of the inner ring, the outer ring and the plurality of connecting parts.

7. The illuminator device according to claim 1, wherein the light source module comprises a substrate and a light source provided on a side of the substrate; and emergent light from the light source is emitted at least after light homogenization or light distribution by the optical member.

8. The illuminator device according to claim 7, wherein the light source is annularly arranged.

9. The illuminator device according to claim 1, wherein the illuminator device further comprises a heat homogenization plate which is provided on an other side of the substrate and is in thermal contact with the heat dissipation member.

10. The illuminator device according to claim 1, wherein the light source module and the driving power supply module are separately provided; and the driving power supply module is fixed in the housing.

11. The illuminator device according to claim 1, wherein the optical member comprises an edge part and a central part; the encloser is provided around the edge part of the optical member; and the central part of the optical member is protruded out of an upper surface of the encloser.

12. The illuminator device according to claim 1, wherein the illuminator device further comprises a heat homogenization plate; and the encloser is combined with the heat homogenization plate.

13. The illuminator device according to claim 1, wherein the heat dissipation member comprises a first end and a second end arranged in an upper-lower direction; and the housing is fixedly connected with the second end of the heat dissipation member and bonded to the second end.

14. The illuminator device according to claim 1, wherein the heat dissipation member comprises a first end and a second end arranged in an upper-lower direction; and the light source module is fixedly connected with the first end of the heat dissipation member and bonded to the first end.

15. The illuminator device according to claim 14, wherein the optical member is a lens or a diffusion shade.

16. The illuminator device according to claim 1, wherein the illuminator device further comprises a lamp holder which is electrically connected with the driving power supply module and configured to electrically connect the illuminator device to an external power supply.

17. A method of manufacturing an illuminator device, comprising:

providing a housing and a heat dissipation member provided at an end of the housing, providing a light source module configured to comprise an end in thermal contact with the heat dissipation member, providing an optical member provided at an other end of the light source module, providing an encloser which positions the optical member at the other end of the light source module, and providing a driving power supply module electrically connected with the light source module, wherein the light source module and the housing are respectively provided at two ends of the heat dissipation member, a plurality of channels communicating inside of the illuminator device with outside of the illuminator device are provided in the illuminator device, and the plurality of channels penetrate through the housing and the heat dissipation member, and wherein the housing comprises a plurality of first through grooves; a plurality of pipes are disposed in the heat dissipation member; the encloser is provided with a plurality of first openings; the plurality of pipes are respectively communicated with the plurality of first through grooves and the plurality of first openings; and the plurality of first through grooves, the plurality of pipes and the plurality of first openings form the plurality of channels.

* * * * *